United States Patent [19]

Schulz et al.

[11] Patent Number: 4,593,179

[45] Date of Patent: Jun. 3, 1986

[54] MULTI FUNCTION AIR HEATER

[76] Inventors: Georg Schulz; George Spector, both c/o George Spector 3615 Woolworth Bldg., 233 Broadway, New York, N.Y. 10007

[21] Appl. No.: 479,823

[22] Filed: Mar. 28, 1983

[51] Int. Cl.[4] ..... F24H 3/04

[52] U.S. Cl. ..... 219/370; 137/341; 137/872; 137/883; 219/367; 219/373; 251/354

[58] Field of Search ..... 219/366–368, 219/370, 373, 365, 380; 34/96–101; 137/341, 883, 872, 873; 251/353, 354

[56] References Cited

U.S. PATENT DOCUMENTS

| | | | |
|---|---|---|---|
| 177,965 | 5/1876 | Shirley | 137/883 |
| 931,881 | 8/1909 | Marr | 34/99 |
| 1,455,034 | 5/1923 | Small | 219/370 |
| 1,509,635 | 9/1924 | Budlong | 219/366 |
| 1,760,782 | 5/1930 | Seeley | 137/872 |
| 1,809,038 | 6/1931 | Hogrebe | 34/97 |
| 2,506,722 | 5/1950 | Kuehn et al. | 251/353 |
| 2,820,479 | 1/1958 | Jenkins | 137/872 |
| 2,856,700 | 10/1958 | Wales | 34/97 |
| 3,104,307 | 9/1963 | Garofalow et al. | 219/368 |
| 3,188,752 | 6/1965 | Skinner | 219/373 |
| 3,190,310 | 6/1965 | Honsinger | 137/883 |
| 3,199,218 | 8/1965 | Bean | 34/98 |
| 3,258,850 | 7/1976 | Swanson | 219/370 |
| 3,444,624 | 5/1969 | Greenlee | 34/98 |
| 3,470,893 | 10/1969 | Nelson | 137/883 |
| 3,771,561 | 11/1973 | Santamaria, Jr. | 137/872 |
| 3,805,833 | 4/1974 | Teed | 137/872 |
| 3,836,750 | 9/1974 | Caruso | 219/368 |
| 4,197,447 | 4/1980 | Jones | 219/367 |
| 4,349,725 | 9/1982 | Sheridan | 219/370 |

FOREIGN PATENT DOCUMENTS

| | | | |
|---|---|---|---|
| 1073180 | 1/1960 | Fed. Rep. of Germany | 219/370 |
| 498331 | 1/1920 | France | 219/365 |
| 141602 | 5/1980 | German Democratic Rep. | 251/353 |

*Primary Examiner*—C. L. Albritton
*Assistant Examiner*—Geoffrey S. Evans

[57] ABSTRACT

A multi-functional air heater and compressor is provided and consists of a cylindrical housing having a closed bottom and an open top, an electric fan affixed vertically in the bottom of the housing, first screen affixed around circumference of the housing to provide an air inlet for the fan, electric filaments for heating the air placed within the housing above the fan, a second screen affixed near the open top of the housing to provide a large air outlet and a plate for directing the air into a plurality of small outlets, the plate located at the open top of the housing.

1 Claim, 6 Drawing Figures

MULTI FUNCTION AIR HEATER

BACKGROUND OF THE INVENTION

The instant invention relates generally to heaters and more specifically it relates to a multi-functional air heater and compressor.

It is a machine that looks like a simple heater but a closer look shows it does much more. By adding a specical plate on the top of the heater that contains a plurality of outlets to which flexible tubes are connected, a person may dry up wet clothes and boots, take hydrotherapy at home, dry hair after a shower, vacuum clean carpets and do many more other useful things.

SUMMARY OF THE INVENTION

A principle object of the present invention is to provide a multi-functional air heater and compression for people who wish to economize on using house and commercial tools and machinery.

Another object is to provide a multi-functional air heater and compressor that will reduce the use of energy consumption to save money.

An additional object is to provide a multi-functional air heater and compressor that requires very little material to be built and takes a short time in assembling to supply the needs of people.

A further object is to provide a multi-functional air heater and compressor that is simple and easy to use.

A still further object is to provide a multi-functional air heater and compressor that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
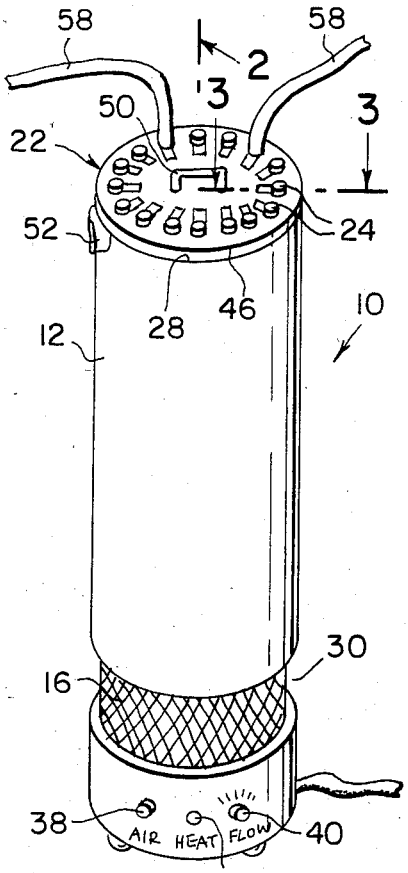
FIG. 1 is a perspective view of the invention.
Figure 2:
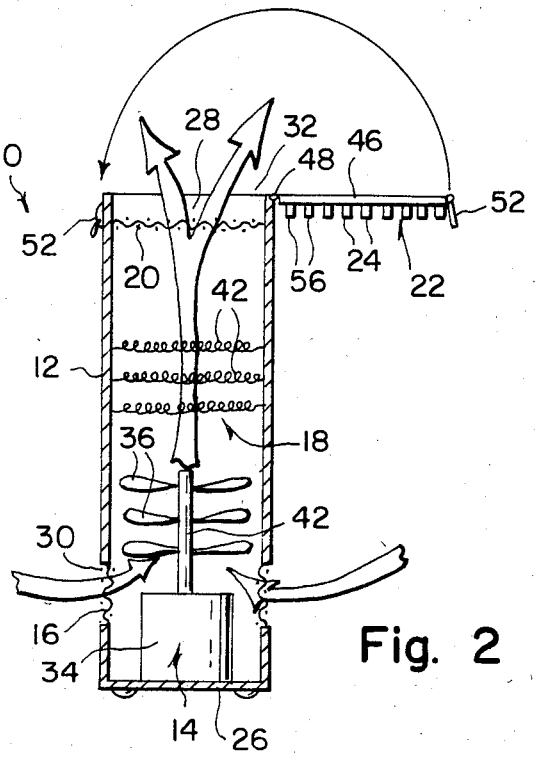
FIG. 2 is a cross sectional view taken along line 2—2 in FIG. 1 with top opened.

Turning now descriptively to the drawings, in which similar reference characters denote similar elements throughout the several views, FIGS. 1 and 2 illustrates a multi-functional air heater and compressor 10 that basically consists of a cylindrical housing 12, an electric fan 14, a first screen 16, a means 18 for heating the air, a second screen 20 and a means 22 for directing the air into a plurality of small outlets 24.

The cylindrical housing 12 has a closed bottom 26 and an open top 28 with the electric fan 14 affixed vertically in the bottom 26 of the housing 12. The first screen 16 is affixed around the circumference of the housing 12 to provide an air inlet 30 for the fan 14.

The means 18 for heating the air is placed within the housing 12 above the fan 14 while the second screen 20 is affixed near the open top 28 of the housing 12 to provide a large air outlet 32.

The means 22 for directing the air into a plurality of small outlets 24 can be placed in a position over the open top 28 of the housing 12.

The electric fan 14 basically consists of an electric motor 34, a plurality of fan blades 36, a switch 38 and a flow control 40.

The electric motor 34 has a shaft 42 with the plurality of fan blades 36 affixed to the shaft 42 to pump in fresh air from the air inlet 30. The switch 38 is placed on the housing 12 and is electrically connected to the electric motor 34 to turn the electric motor 34 on and off. The flow control 40 is placed on the housing 12 and is electrically connected to the electric motor 34 to determine the speed of the motor 34 to increase and decrease the force of the air.

The means 18 for heating the air basically consists of a plurality of filaments 42 and a switch 44. Each filament 42 is placed transverse within the housing 12 to heat up the air and the switch 44 is placed on the housing 12 and is electrically connected to the filaments 42 to turn the filaments 42 on and off.

The means 22 for directing the air into a plurality of small outlets 24 basically consists of a plate 46, a hinge 48, a handle 50, a bracket 52, a plurality of tracks 54, a plurality of small pipes 56 and a plurality of flexible tubes 58.

Figure 3:
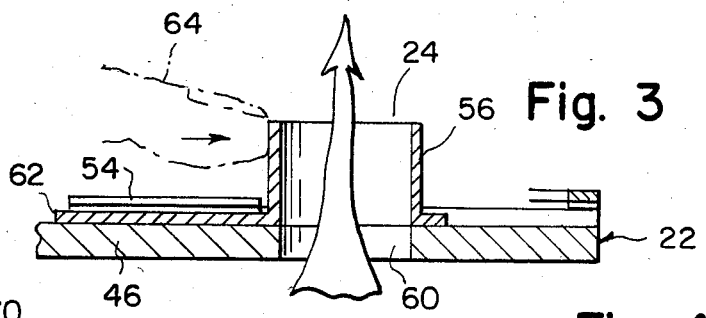
FIG. 3 is a cross sectional view taken along line 3—3 in FIG. 1.

The plate 46 has a plurality of small apertures 60 as best seen in FIG. 3. The hinge 48 is affixed to edge of the plate 46 and the open top 28 of the housing 12 so that the plate 46 can be turned to a position over the open top 28 of the housing 12. The handle 50 is affixed to the top of the plate 46 permitting easy lifting of the plate 46.

The bracket 52 is affixed to opposite edge of the plate 46 and the open top 28 of the housing 12 so that the plate 46 can be locked and unlocked in position over the open top 28 of the housing 12.

Figure 4:
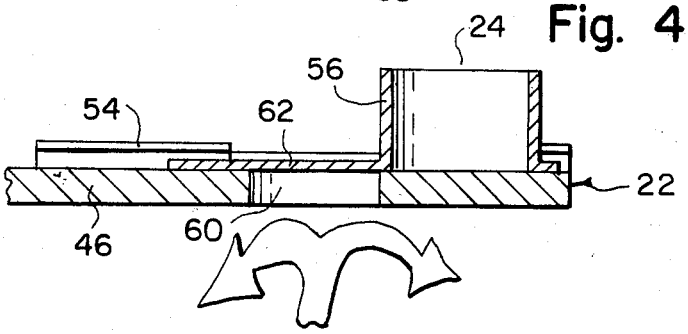
FIG. 4 is a cross sectional view similar to FIG. 3 showing closing of an outlet.

Each track 54 is positioned over a small aperture 60 in the plate 46 and each pipe 56 has a bottom flange 62. The flange 62 is placed within a track 54 so that the pipe 56 aligns with the aperture 60 in the plate 46 as shown in FIG. 3. Closing off the air flow of each pipe 56 is accomplished by pushing against the pipe 56 with a finger 64 causing a sliding movement of the flange 62 within the track 54 until the pipe 56 is unaligned with the aperture 60 of the plate 46 (see FIG. 4).

FIG. 1 shows each tube 58 plugged into a small pipe 56. Each of the tubes 58 is used to perform a different function of the multi-functional air heater and compressor 10.

FIG. 1 also shows the plurality of small pipes 56 positioned in a circular manner. These pipes 56 in a number determined by the manufacturer may be in a closed or open state depending upon what job the heater 10 must do and what pressure of air flow is required. Suppose that tweleve pipes 56 are positioned and that six must be closed, the pressure of air flow will be two times as high in each of the six other pipes 56.

Figure 5:
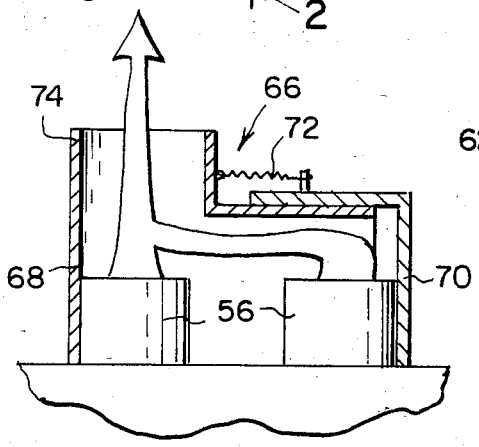
FIG. 5 is a cross sectional view of a modification showing an expandable telescoping cover over two outlets.
Figure 6:
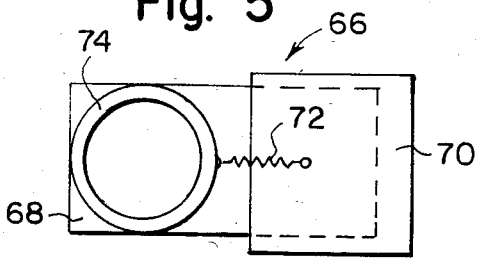
FIG. 6 is a top view of FIG. 5.

FIGS. 5 and 6 shows a telescoping cover 66. The cover 66 being in two sections 68 and 70 is spring loaded at 72 so it snugly fits over two outlets 56 on the plate 46. One of the flexible tubes 58 (not shown) is plugged into the cover at 74 combining the two air flows from the two outlets 56 into one stronger air flow into the flexible tube 58.

When the plate 46 is in an opened position the machine 10 is used as a heater and can warm up rooms in stages. During the warm days of summer, the plate 46 is closed and one or more tubes 58 provides refreshing air to cool the user. During the long months of winter, the machine 10 transforms itself into a dryer for wet clothes, messy gloves and boots. As a matter of fact, boots are always hard to dry up but with the tube 58 plugged into it and filling it with warm and dry air, the time of drying will be diminushed. When a person takes a bath and washes hair the heater 10 will do the job of any hair dryer for men and women. Different pressures of air flow may be acquired by closing some pipes 56 while many people may use the machine 10 at the same time.

When the night is very cold and windows are all iced up, it is indeed a nice idea to de-ice them fast and properly with the heater 10. When your feet are hurting you after a hard day, the heater 10 will help. It will furnish a pressure-bubble bath for your feet providing a fast pain relief with air-water massage. It may be used as a jet-stream during a bath, presenting the possibilities of several kinds of hydro-therapy.

Somebody spills ashes on the rug or table. A simple plastic pipe and bag is utilized for that special purpose. The heater 10 becomes a vacuum cleaner and all the dirt will be sucked into it. A party is planned with lots of balloons. With a simple plastic 'Y' shaped pipe added to the end of one tube 58 the heater becomes an air-compressor and does the job easily. If a room needs a new coat of paint it can be done with a paint-air-spray. Tubes connected to air driven power or kitchen tools makes the heater 10 desirable. You can also use the heater 10 as an air blower to clear away dirt when you're working.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A multi function air heater and compressor which comprises:

(a) a cylindrical housing having a closed bottom and an open top;

(b) an electric fan affixed vertically in the bottom of the housing;

(c) first screen affixed around circumference of the housing to provide an air inlet for the fan;

(d) means for heating the air within the housing above the fan;

(e) a second screen affixed near the open top of the housing to provide a large air outlet; and (f) means for directing the air into a plurality of small outlets, the means for directing the air can be placed in position over the open top of the housing wherein the electric fan comprises:

(a) an electric motor having a shaft;

(b) a plurality of fan blades affixed to the shaft to pump in fresh air from the air inlet;

(c) a switch electrically connected to the electric motor to turn the electric motor on and off, the switch placed on the housing; and (d) a flow control electrically connected to the electric motor to determine the speed of the motor to increase and decrease the force of air, the flow control placed on the housing wherein the means for heating air comprises:

(a) a plurality of filaments, each filament placed transversely with the housing; and (b) a switch electrically connected to the filaments to turn the filaments on and off, the switch placed on the housing wherein the means for directing the air into a plurality of small outlets comprises:

(a) a plate having a plurality of small apertures;

(b) a hinge affixed to edge of the plate and the open top of the housing so that the plate can be turned to a position over the open top of the housing;

(c) a handle affixed to top of the plate, the handle permitting easy lifting of the plate;

(d) a bracket affixed to opposite edge of the plate and the open top of the housing so that the plate can be locked and unlocked in position over the open top of the housing; and (e) a plurality of tracks, each track positioned over a small aperture in the plate;

(f) a plurality of small pipes, each pipe having a bottom flange, the flange placed within a track so that the pipe aligns with the aperture in the plate whereby closing off the air flow of each pipe is accomplished by pushing against the pipe with a finger causing a sliding movement of the flange within the track until the pipe is aligned with the aperture of the plate; and (g) a plurality of flexible tubes, each tube plugged into a small pipe whereby each of the tubes is used to perform a different function of the multi-functional air heater and compressor further comprising a telescoping cover, the cover being in two sections is spring loaded so it snugly fits over two outlets on the plate whereby one of the flexible tubes is plugged into the cover combining the two air flows from the two outlets into one stronger air flow into the flexible tube.

* * * * *